US011761304B1

(12) United States Patent
Agbo et al.

(10) Patent No.: US 11,761,304 B1
(45) Date of Patent: Sep. 19, 2023

(54) SUBSURFACE SAFETY VALVE OPERATION MONITORING SYSTEM

(71) Applicant: Saudi Arabian Oil Company, Dhahran (SA)

(72) Inventors: Emeka Agbo, Al Rakah (SA); Luai A. Sukkar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/824,302

(22) Filed: May 25, 2022

(51) Int. Cl.
*E21B 34/14* (2006.01)
*E21B 43/12* (2006.01)

(52) U.S. Cl.
CPC ..... *E21B 34/14* (2013.01); *E21B 43/12* (2013.01); *E21B 2200/05* (2020.05)

(58) Field of Classification Search
CPC ..... E21B 34/10; E21B 34/14; E21B 43/12; E21B 2200/05
See application file for complete search history.

(56) References Cited

U.S. PATENT DOCUMENTS 5,666,050 A * 9/1997 Bouldin ..... G01D 5/2033 324/207.16
8,237,443 B2 * 8/2012 Hopmann ..... E21B 47/092 324/306
8,902,078 B2 * 12/2014 Vick, Jr. ..... E21B 34/14 340/854.3
2006/0157240 A1 * 7/2006 Shaw ..... E21B 47/09 166/66
2021/0356054 A1 * 11/2021 Joseph ..... F16K 37/0033

* cited by examiner

*Primary Examiner* — Matthew R Buck
(74) *Attorney, Agent, or Firm* — Fish & Richardson P.C.

(57) ABSTRACT

A system includes a subsurface safety valve assembly connected to a production tubing string and including a sensor assembly disposed on its outer surface. The sensor assembly includes a magnetic sensor configured to measure a magnetic field or a sonic sensor configured to measure a sonic signal, and is configured to measure a change in a parameter caused by change in position of a closure member that is configured to selectively permit fluid flow through the central bore of the subsurface safety valve. The system further includes a control unit positioned at a surface location and that is configured to receive, from sensor assembly, a measurement of the change in the parameter, wherein the measurement is a change in the magnetic field or a change in the sonic signal.

8 Claims, 6 Drawing Sheets

SUBSURFACE SAFETY VALVE OPERATION MONITORING SYSTEM

TECHNICAL FIELD

This disclosure relates generally to fluid flow control within a subterranean well and in particular, to subsurface safety valves located downhole within the subterranean well.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include casing cemented in the wellbore to help control the well and maintain well integrity, and a production tubing positioned within the casing through which oil, gas, or other produced fluids can flow from the producing formation to the surface.

A subsurface safety valve can be installed on the production tubing some distance below the surface. The subsurface safety valve can be configured to close in the event of an emergency or other condition, thereby preventing flow of fluid from the production tubing.

SUMMARY

Certain aspects of the subject matter herein can be implemented as a well system. The system includes a production tubing string positioned within a wellbore and a subsurface safety valve assembly connected to the production tubing string. The subsurface safety valve assembly includes a main body with a central bore therethrough that is fluidically connected to the production tubing string and a closure member configured to permit fluid flow through the central bore when in an open position and prevent fluid flow through the central bore when in a closed position. The system further includes a sensor assembly disposed on the subsurface safety valve assembly and across a wall of the main body from the central bore. The sensor assembly includes a magnetic sensor configured to measure a magnetic field or a sonic sensor configured to measure a sonic signal, and is configured to measure a change in a parameter caused by change in position of the closure member. The system further includes a control unit positioned at a surface location, configured to receive, from sensor assembly, a measurement of the change in the parameter, wherein the measurement is a change in the magnetic field or a change in the sonic signal and display, on an output device, the measurement received from the sensor assembly.

An aspect combinable with any of the other aspects can include the following features. The sensor assembly can include the magnetic sensor and the change in the parameter can be the change in the magnetic field.

An aspect combinable with any of the other aspects can include the following features. The sensor assembly can further include the sonic sensor, and the control unit can be configured to further receive the change in the sonic signal.

An aspect combinable with any of the other aspects can include the following features. The control unit can include non-transitory computer readable medium storing computer instructions executable by one or more processors to perform operations. The operations can include determining, based on the measurement received from the sensor assembly, the change in the position of the closure member, and displaying, on the output device, an indication of the change in the position of the closure member.

An aspect combinable with any of the other aspects can include the following features. The wall can be a pressure barrier between the central bore and an annulus partially defined by an outer surface of the production tubing string.

An aspect combinable with any of the other aspects can include the following features. The magnetic sensor can be further configured to induce the magnetic field.

Certain aspects of the subject matter herein can be implemented as a downhole assembly. The assembly includes a subsurface safety valve assembly that includes a main body with a central bore therethough, wherein the central bore is configured to be fluidically connected with a production tubing string positioned within a wellbore, and a closure member configured to permit fluid flow through the central bore when in an open position and prevent fluid flow through the central bore when in a closed position. The assembly further includes a sensor assembly disposed on the subsurface safety valve assembly and across a wall of the main body from the central bore. The sensor assembly includes a magnetic sensor or a sonic sensor and configured to measure a change in the magnetic field or a change in the sonic signal caused by a change in position of the closure member.

An aspect combinable with any of the other aspects can include the following features. The sensor assembly can include the magnetic sensor and the sonic sensor. The sensor assembly can be configured to measure the change in the magnetic field and the change in the sonic signal.

An aspect combinable with any of the other aspects can include the following features. The sensor assembly can be disposed on an outer surface of the subsurface safety valve assembly.

An aspect combinable with any of the other aspects can include the following features. The wall can be configured to be a pressure barrier between the central bore and an annulus partially defined by an outer surface of the production tubing string.

An aspect combinable with any of the other aspects can include the following features. The magnetic sensor can be further configured to induce the magnetic field.

Certain aspects of the subject matter herein can be implemented as a method. The method includes receiving, from a sensor assembly disposed on an outer surface of a subsurface safety valve assembly connected to a production tubing string positioned within as wellbore and comprising a magnetic sensor or a sonic sensor, a measurement of a change in a parameter caused by a change in position of a closure member within a main body of the subsurface safety valve assembly. The closure member is configured to permit fluid flow through the central bore when in an open position and prevent fluid flow through a central bore when in a closed position. The parameter is a magnetic field measured by the magnetic sensor or a sonic signal measured by the sonic sensor. The method further includes determining, based on the measurement, the change in position of the closure member.

An aspect combinable with any of the other aspects can include the following features. The sensor assembly can include the magnetic sensor and the change in the parameter can be the change in the magnetic field.

An aspect combinable with any of the other aspects can include the following features. The sensor assembly can further include the sonic sensor, and the method can further include receiving, from the sensor assembly, the change in the sonic signal, and the determining the change in position of the closure member can be based on the change in the magnetic field and the change in the sonic signal.

An aspect combinable with any of the other aspects can include the following features. The sensor assembly can be disposed across a wall of the main body from the central bore, and wherein the wall is a pressure barrier between the central bore and an annulus partially defined by an outer surface of the production tubing string.

The details of one or more embodiments are set forth in the accompanying drawings and the description below. Other features, objects, and advantages will be apparent from the description, drawings, and claims.

DETAILED DESCRIPTION

Figure 1:
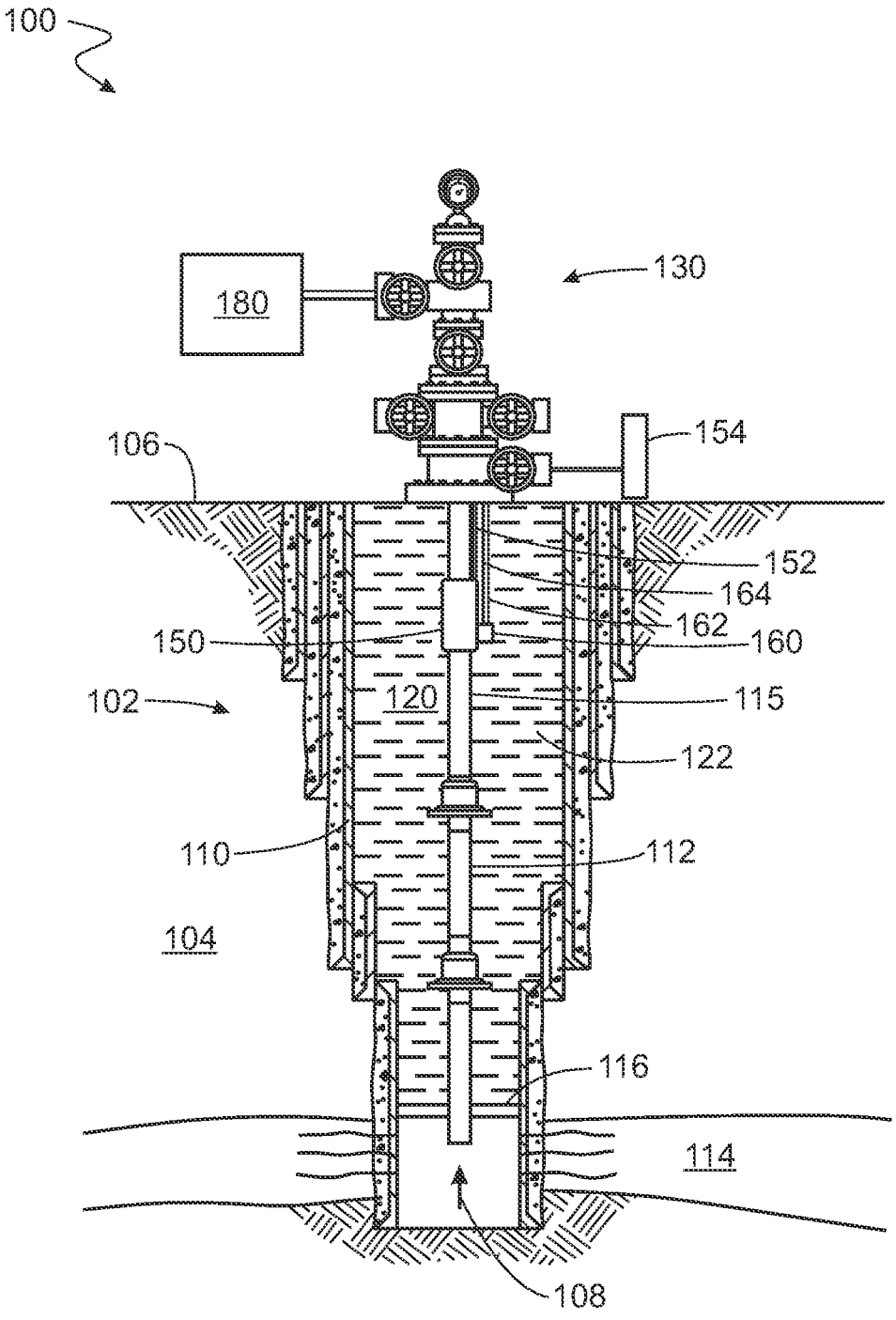
FIG. 1 is a schematic illustrations of a well system in accordance with an embodiment of the present disclosure.

Subsurface safety valves (SSSVs) can provide a fail-safe mechanism for preventing fluid flow through a production tubing in the event of an emergency or other condition. SSSVs can be controlled via hydraulic pressure from a control line extending from the surface to the SSSV, pressure from which opens or closes a flapper or other closure member.

In the event of an emergency or other condition necessitating (or making desirable) SSSV closure, an operator may need to confirm that the closure member has in fact moved to the closed position at the proper time and that full closure has occurred. Similarly, it can be desirably or necessary under other conditions to confirm or determine other changes in the position of the closure member (for example, to confirm full opening of the SSSV). Several methods have conventionally been used to determine the position of an SSSV closure member, including the well head pressure, pressure applied on the valve from surface through the control line, the number of strokes on a hand pump pressurizing the control line, and the volume of hydraulic fluid recovered once the pressure applied through the control line is bled off. Such methods of determining the position of the SSSV closure member can be uncertain and have other limitations, for example, if the integrity of the SSSV is compromised or if the wellhead pressure is zero.

In accordance with an embodiment of the present disclosure, an improved system and method for determining a closure or other change in position of a closure member of a SSSV is disclosed. In some embodiments, a sensor assembly comprising a sonic sensor, a magnetic sensor, or both is disposed on the SSSV, and sonic or magnetic measurements from the sensors can be received by an operator, enabling the operator to determine, based on the measurements, if a valve closure or other closure member position change has occurred. The method and system of the present disclosure can minimize the risk associated with uncertainty of SSSV closure member position, reduce the risk of closure member damage (such as flapper damage) during intervention, and reduce the risk of loss of downhole intervention tools, thus reducing costs, reducing environmental and safety risks, and increasing production.

In some embodiments, the sensor assembly is disposed on the outer surface of the SSSV assembly across a wall of the main body from the central bore of the SSSV in the tubing-casing annulus (TCA) and, in some embodiments, the wall is a pressure barrier isolating the central bore from the TCA. Thus, in some embodiments, high pressures or flow rates or changes in pressures or flow rates through the central bore (due to, for example, a blowout or other well control event) would not damage or otherwise affect the sensor assembly. In some embodiments, the sensor assembly can be ruggedized so as to withstand high pressures (for example, 10,000 psi or higher) and high temperatures (for example, 300 degrees Fahrenheit or higher) within the TCA.

FIG. 1 is a schematic illustrations of a well system in accordance with an embodiment of the present disclosure. Referring to FIG. 1, well system 100 includes a wellbore 102 drilled into a subterranean zone 104 from the Earth's surface 106. Casing string 110 is disposed within wellbore 102 and can include multiple nested casings of different diameters, and can be perforated (for example, proximate to its downhole end) so as to allow produced fluids to flow into the cased wellbore.

Production tubing string 112 is positioned within casing string 110 and provides a passageway through which produced fluid 108 from production zone 114 of subterranean zone 104 can reach the surface 106. A production packer 116 anchors and isolates the bottom of the production tubing string.

The inner surface of casing string 110 and the outer surface 115 of production tubing 112 define (or partially define) the tubing-casing annulus (TCA) 120. A fluid 122 fills or substantially fills the volume of the TCA 2120 and can be composed of brine or diesel or other suitable fluid. Well system 100 further includes a wellhead assembly 130 which can include hangers for casing string 110 and production tubing string 112 and can include various valves, spools, pressure gauges and chokes to regulate and control production of produced fluids 108 from wellbore 102. Produced fluids 108 can be flowed from wellhead assembly 130 via a production line (not shown) or other conveyance towards pipelines or other surface treatment, gathering, or conveyance facilities.

Well system 100 also includes a subsurface safety valve (SSSV) assembly 150 connected to production tubing string 112. As described in greater detail in reference to FIGS. 2A and 2B, SSSV assembly 150 can, in some embodiments, include a main body with a central bore being fluidically connected to the production tubing string. For example, in some embodiments, a central axis of the central bore is parallel and coincident with the central axis of the central bore of production tubing string. SSSV assembly 150 can include a closure member (such as a flapper) that permits fluid flow through the central bore when in an open position (thus permitting fluid to flow in an uphole direction through production tubing 112) and that prevents fluid flow through the central bore when in a closed state (thus preventing fluid flow in an uphole direction through production tubing 112). Switching between the closed state and the open state can, in some embodiments, be in response to a change in fluid pressure in a control line 152 extending from a pressure source 154 at or near surface 106 to SSSV assembly 150. Well system 100 can be configured such that, in normal operations, SSSV assembly 150 is in the open state (for example, in response to pressure from control line 152). In an emergency or other situation in which prevention of fluid flow uphole through production tubing 112 to surface 106 is required or desirable, SSSV assembly 150 can be switched to the closed state (for example, in response to a reduction or removal of pressure from control line 152). In some embodiments, SSSV assembly 150 can be in a "fail-safe" configuration, such that a surface event that disables, destroys, or shuts down surface equipment results in a loss in pressure in the control line, which, in turn, causes the closure member of SSSV assembly 150 to close.

Well system 100 further includes a sensor assembly 160 disposed on SSSV assembly 150. As described in greater detail with respect to FIGS. 2A and 2B, sensor assembly 160 can include one or more sensors configured to measure parameters indicative of a change in position of the closure member of SSSV assembly 150. For example, in some embodiments, sensor assembly 160 can include a magnetic sensor, a sonic sensor, or both, configured to measure magnetic or sonic signals indicative of, for example, a flapper or other closure member rotating towards and striking against the flapper seat as the flapper switches from the open position to the closed position.

It will be understood that sensor assembly 160 disposed on SSSV assembly 150 can include embodiments wherein sensor assembly 160 is disposed on an outer surface of SSSV assembly 150 such that sensor assembly 160 protrudes from SSSV assembly 150 into TCA 120, and also embodiments wherein sensor assembly 160 is flush with the outer surface of SSSV assembly 150 or embedded or enclosed within an outer covering of SSSV assembly 150. In some embodiments, sensor assembly 160 is a modular unit that can easily be attached to or removed from an existing SSSV assembly, such that no redesign or other alteration of a standard or off-the-shelf SSSV assembly is required for such a system to enable or include the sensing features provided by the sensor assembly, and the sensor assembly can be easily transported to and installed on different SSSVs in different wells.

In some embodiments, sensor assembly 160 is disposed across a wall 203 of main body 202 from the central bore 204 of the SSSV assembly 150, and, in some embodiments, wall 203 is a pressure barrier between the central bore 204 and TCA 120. Thus, in some embodiments, high pressures or flow rates or changes in pressures or flow rates through the central bore (due to, for example, a blowout or other well control event) would not damage or otherwise affect sensor assembly 160.

Well system 100 can further include a power cable 162 which can be configured to supply electrical power to sensor assembly 160 (and its component sensors) and a transmitter cable 164 which can be configured to carry data signals from (or to) sensor assembly 160 to (or from) sensor control module 180. Sensor control module 180 can in some embodiments include a surface panel or other output device for displaying measurements from one or more of the sensors in sensor assembly 160, the status of the sensors, and other information, and for sending power and control signals to the sensor. For example, in some embodiments, sensor control module 180 can receive a measurement of a change in a magnetic field or a measurement of a sonic signal from the sensors and display the measurements, allowing an operator to determine, based on the measurements, whether the opening, closing, or other change in the position of the closure member has occurred.

In some embodiments, sensor control module 180 is at the wellsite proximate to wellhead assembly 130 and other wellsite equipment. In other embodiments, control unit 180 can be remote from the wellsite. In some embodiments, control unit 180 can be part of and/or in communication with other remote or wellsite monitoring and control systems such as, for example, as system for controlling pressure source 154. In some embodiments, control unit 180 can be (or can be part of, or be connected to) a supervisory control and data acquisition (SCADA) system. In some embodiments, sensor control module 180 is a portable system.

In some embodiments, sensor control module 180 can be (or can include) a computer system that comprises one or more processors, and a computer-readable medium (for example, a non-transitory computer-readable medium) storing computer instructions executable by the one or more processors to perform operations. For example, in some embodiments, sensor control module 180 can be programmed to analyze the measurements received from the sensors of the sensor assembly and determine based on the analysis (for example, by comparing a time series of measurements to a reference time series of that parameter) that a closing of the closure member (or other change in the position of the closure member) has occurred, and then display on the output device or otherwise alert (or confirm to) the operator that the closing or other change has occurred.

Figure 2A:
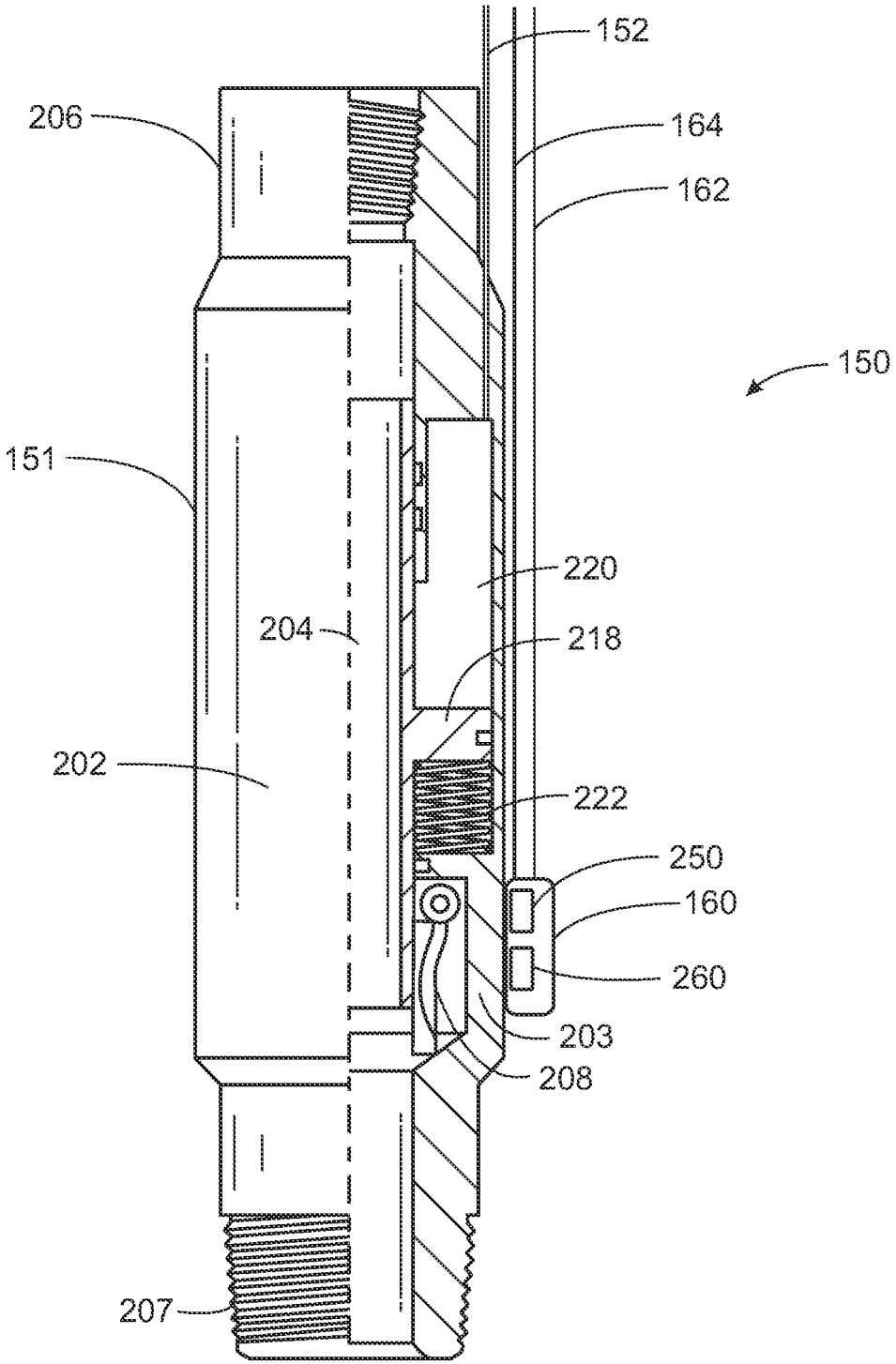
FIGS. 2A and 2B are schematic illustrations of a sensor assembly disposed on a subsurface safety valve in accordance with an embodiment of the present disclosure.
Figure 2B:
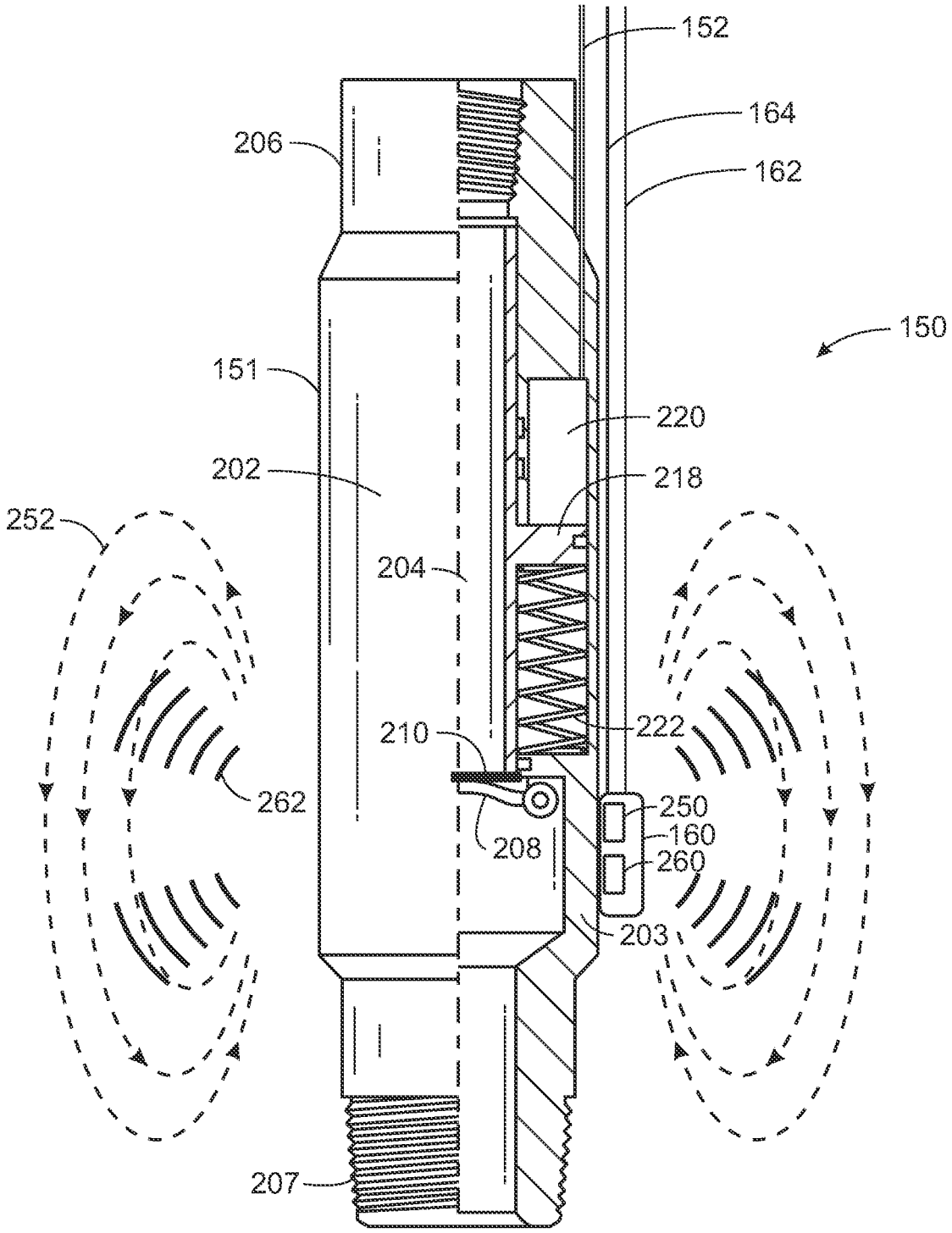

FIGS. 2A and 2B are schematic illustrations showing more detail of SSSV assembly 150 in accordance with an embodiment of the present disclosure. Referring to FIG. 2A, SSSV assembly 150 includes a main body 202 with central bore 204. Threaded upper end 206 and lower end 207 can be connected to production tubing (such as production tubing 112 of FIG. 1). Closure member 208 permits fluid flow through central bore 204 when in an open position (as shown in FIG. 2A) and that prevents fluid flow through the central bore when closure member 208 is rotated to the closed position (as shown in FIG. 2B). In the illustrated embodiment, closure member 208 is a flapper. In some embodiments, closure member 208 can be a ball, poppet, or other type of closure member. SSSV assembly 150 is in its open state when closure member 208 is in the open position (FIG. 2A) and in its closed state when closure member rotates to a closed position (FIG. 2B). SSSV assembly 150 includes a piston 218 which can push closure member 208 to the open position. If pressure from control line 152 into piston chamber 220 exceeds a threshold to overcome the biasing force of spring 222, piston 218 slides in a downhole direction, causing closure member 208 to move to the open position (FIG. 2A). When fluid pressure in the tubing-casing annulus is decreased to below this threshold, the force of spring 222 causes piston 218 to slide in the uphole direction, allowing closure member 208 to move to the closed position.

Sensor assembly 160 is attached to outer surface 151 of SSSV assembly 150 and can include one or more sensors. In the illustrated embodiment, sensor assembly 160 includes a magnetic sensor 250 and a sonic sensor 260. In other embodiments, sensor assembly 160 can include only a magnetic sensor, only a sonic sensor, or other or additional sensors. As described above in reference to FIG. 1, power cable 162 can supply electrical power to sensor assembly 160 (and its component sensors) and a transmitter cable 164 can carry data signals from (or to) sensor assembly 160 to (or from) a sensor control module at a surface or other suitable location.

Magnetic sensor 250 can, in some embodiments, include a coil-and-magnet arrangement similar to a casing-collar locator, with two like-facing magnetic poles positioned on either side of a central coil through which current is induced, generating an electrical field 252 which can partially extend through SSSV assembly 150. Changes in the magnetic field can be measured by the sensor and transmitted via transmitter cable 164. Movement of closure member 208 (for example, during closure) can change or distort the magnetic lines of flux, and this distortion gives rise to a changes in the magnetic field around the conducting coil. The change in the magnetic field can be received and analyzed directly by the operator, or analyzed by an automated computerized process, to determine the closure state. In some embodiments, magnetic sensor 250 can have a similar design as, or be adapted from, a casing-collar locator tool of the types available from Schlumberger, Baker Hughes, Halliburton, and others, sized so as to pass through the TCA when attached to outer surface 151 of SSSV assembly 150.

Sonic sensor 260 can, in some embodiments, be an acoustic noise/sonde sensor such as the ultrasound tool available from Archer Limited or the spectral noise tool available from TGT Oilfield Services. Changes to sonic signals 262 could result from a change in position of closure member 208. For example, characteristic abrupt changes in sonic signals 262 could emanate from closure member 208 forcefully striking seat 210 as closure member 208 rotates shut. Characteristic sonic signals 262 could also emanate from fluid flowing at a high velocity through central bore 204 and across closure member 208 when in an open or intermediate state. The sonic signals and changes therein can be received and analyzed directly by the operator and compared, for example, in time series, or analyzed by an automated computerized process, to determine the closure state or changes to the closure state (opening or closing) of the closure member.

In the embodiment shown in FIGS. 2A and 2B, sensor assembly 160 and included magnetic sensor 250 and sonic sensor 260 are disposed on outer surface 151 of SSSV assembly 150 at a location nearest the hinge of the closure member (flapper) (i.e., across wall 203 of main body 202 nearest the hinge of the flapper and the mass of the body of the flapper when in the open position). So positioned, distortion of the magnetic field 252 and changes in the sonic signals due to movement of the closure member can be more easily detected by sensor due to the proximity of the flapper body laying close to the sensor assembly 160 when in the open position and the rotation of the flapper away from the sensors during closure. In some embodiments, only a magnetic sensor (and not the sonic sensor) is included. In some embodiments, only a sonic sensor (and not the magnetic sensor) is included. In some embodiments, both the magnetic sensor and the sonic sensor are included and, in some embodiments, additional or further sensors can be included. In some embodiments, the two different measurements (magnetic and sonic) can be complimentary and/or used to confirm determinations based on one or the other. For example, a sonic signature can be used to confirm a closure member movement determination initially made based on magnet sensor data. Additionally, or in the alternative, magnet sensor data can be used to confirm a closure member movement determination initially made based on sonic data.

Figure 3:
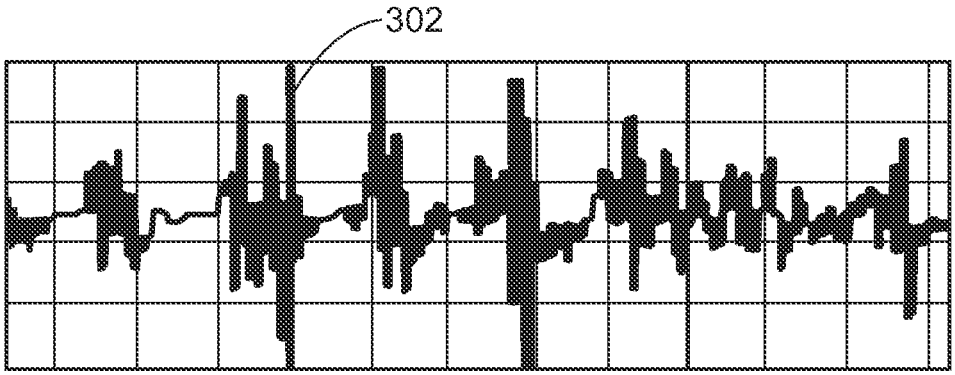
FIG. 3 is a graph of hypothetical magnetic data reading from a magnetic sensor of a sensor assembly disposed on a subsurface safety valve in accordance with an embodiment of the present disclosure.

FIG. 3 is an example of hypothetical magnetic data readings from a magnetic sensor disposed on a subsurface safety valve assembly, during a change in position of the closure member of the subsurface safety valve assembly, in accordance with an embodiment of the system disclosed herein. Data indicating a large distortion on the magnetic field (for example, at or near at point 302) can be indicative of the movement of the closure member. The system can be calibrated in a lab setting, taking into account factors such as the shape, configuration, and composition of the closure member and related components, such that characteristic distortion signatures indicative of closure member movement can be recognized when the system is deployed downhole. For example, the system can be calibrated such that closure of the closure member corresponds to a zero reading, and any departure over zero indicates opening of the closure member.

Figure 4:
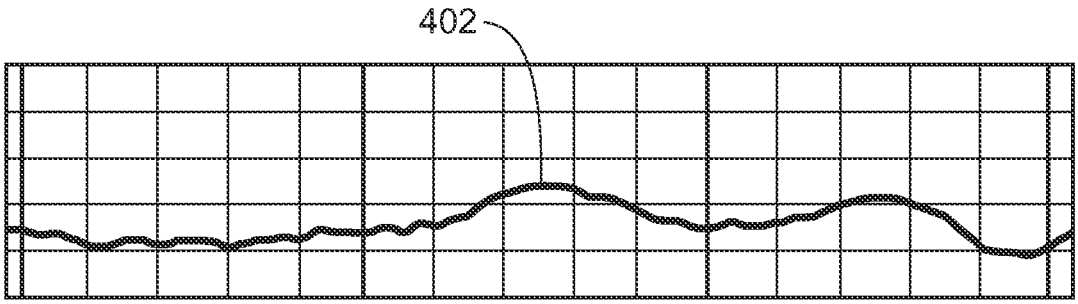
FIG. 4 is a graph of hypothetical magnetic data reading from a sonic sensor of a sensor assembly disposed on a subsurface safety valve in accordance with an embodiment of the present disclosure.

Similarly, FIG. 4 is an example of hypothetical sound amplitude readings from a sonic sensor disposed on a subsurface safety valve assembly, during a change in position of the closure member of the subsurface safety valve assembly. A amplitude peak event (for example, at or near point 402) can be indicative of movement of the closure member. The units and scales for decibel timescale and the closure and opening readings can be established during a lab test, prior to downhole deployment. For example, sound readings during closure member movement between the open and closed position can be recorded to establish a characteristic noise signal from the movement. The sound reading may suddenly peak as the closure member strikes the flapper seat or other assembly components as the closure member fully closes or fully opens.

Figure 5:
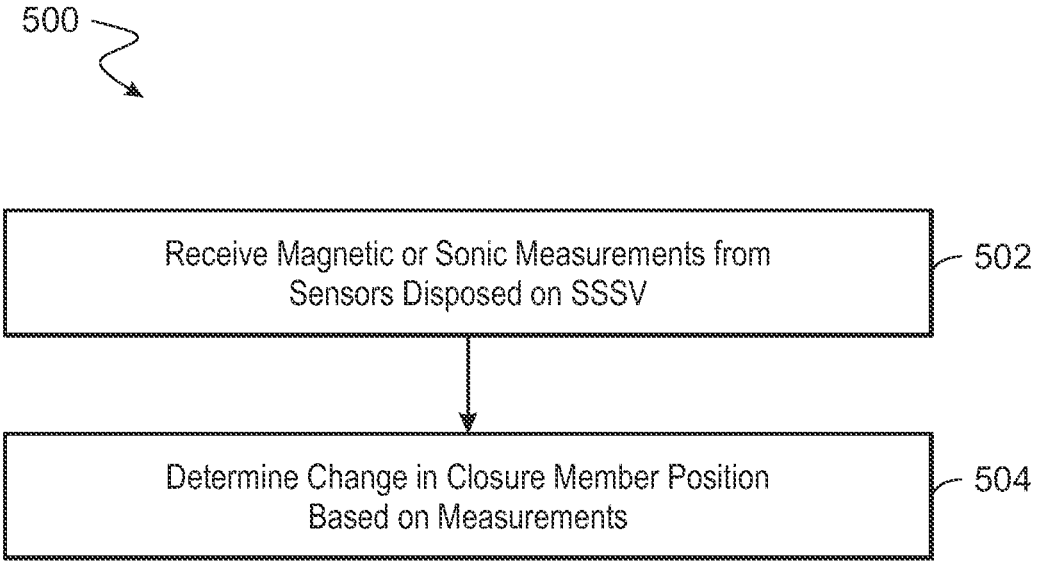
FIG. 5 is a process flow diagram of a method of determining a change in a position of the closure member of a subsurface safety valve in accordance with an embodiment of the present disclosure.

FIG. 5 is a process flow diagram of a method 500 of determining a change in a position of the closure member of a subsurface safety valve in accordance with an embodiment of the present disclosure. Method 500 will be described in reference to system 100 described in reference to FIG. 1; specifically, the subsurface safety valve is connected to a production tubing string positioned within a wellbore, and the subsurface safety valve assembly includes a main body with a central bore therethrough fluidically connected to the production tubing string and a closure member that permits fluid flow through a central bore when in an open position and that prevents fluid flow through a central bore when in a closed position. A sensor assembly is disposed on the subsurface safety valve assembly, and the sensor assembly can include a magnetic sensor configured to induce a magnetic field and to measure a change in the magnetic field caused by a change in position of the closure member, and/or can include a sonic sensor configured to measure a sonic signal caused by the change in position of the closure member. Method 500 begins at step 502 wherein an operator receives a measurement of a change in a magnetic field or of a sonic signal from the sensor assembly. Proceeding to step 504, the operator determines, based on the measurement, a change in position of the closure member.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A well system comprising:

a production tubing string positioned within a wellbore;

a subsurface safety valve assembly connected to the production tubing string, the subsurface safety valve assembly comprising:

a main body with a central bore therethrough, the central bore fluidically connected to the production tubing string; and a closure member configured to permit fluid flow through the central bore when in an open position and prevent fluid flow through the central bore when in a closed position;

a sensor assembly disposed on the subsurface safety valve assembly and across a wall of the main body from the central bore, the sensor assembly comprising a sonic sensor configured to measure a sonic signal, the sensor assembly configured to measure a change in a parameter caused by change in position of the closure member; and a control unit positioned at a surface location, the control unit configured to:

receive, from the sensor assembly, a measurement of the change in the parameter, wherein the measurement is a change in the sonic signal;

display, on an output device, the measurement received from the sensor assembly.

2. The well system of claim 1, wherein the control unit comprises a non-transitory computer readable medium storing computer instructions executable by one or more processors to perform operations, the operations comprising:

determining, based on the measurement received from the sensor assembly, the change in the position of the closure member; and displaying, on the output device, an indication of the change in the position of the closure member.

3. The well system of claim 1, wherein the wall is a pressure barrier between the central bore and an annulus partially defined by an outer surface of the production tubing string.

4. A downhole assembly comprising:

a subsurface safety valve assembly comprising:

a main body with a central bore therethough, wherein the central bore is configured to be fluidically connected with a production tubing string positioned within a wellbore;

a closure member configured to permit fluid flow through the central bore when in an open position and prevent fluid flow through the central bore when in a closed position;

a sensor assembly disposed on the subsurface safety valve assembly and across a wall of the main body from the central bore, the sensor assembly comprising a sonic sensor and configured to measure a change in the sonic signal caused by a change in position of the closure member.

5. The downhole assembly of claim 4, wherein the sensor assembly is disposed on an outer surface of the subsurface safety valve assembly.

6. The downhole assembly of claim 4, wherein the wall is configured to be a pressure barrier between the central bore and an annulus partially defined by an outer surface of the production tubing string.

7. A method comprising:

receiving, from a sensor assembly disposed on an outer surface of a subsurface safety valve assembly connected to a production tubing string positioned within a wellbore and comprising a sonic sensor, a measurement of a change in a parameter caused by a change in position of a closure member within a main body of the subsurface safety valve assembly, wherein the closure member is configured to permit fluid flow through a central bore when in an open position and prevent fluid flow through the central bore when in a closed position, wherein the parameter is a sonic signal measured by the sonic sensor;

determining, based on the measurement, the change in position of the closure member.

8. The method of claim 7, wherein the sensor assembly is disposed across a wall of the main body from the central bore, and wherein the wall is a pressure barrier between the central bore and an annulus partially defined by an outer surface of the production tubing string.

* * * * *